United States Patent [19]

Conde et al.

[11] 4,418,742

[45] Dec. 6, 1983

[54] ROTOR CONSTRUCTION FOR ROTARY REGENERATIVE AIR HEATER

[75] Inventors: James C. Conde, North Royalton; Paul S. Larsen, Canal Fulton, both of Ohio

[73] Assignee: The Babcock & Wilcox Company, New Orleans, La.

[21] Appl. No.: 386,169

[22] Filed: Jun. 7, 1982

[51] Int. Cl.[3] ..... F28D 19/04

[52] U.S. Cl. ..... 165/8; 165/10

[58] Field of Search ..... 165/8, 10

[56] References Cited

U.S. PATENT DOCUMENTS 3,710,851 1/1973 Finnemore ..... 165/10 X 3,861,013 1/1975 Kurschner et al. ..... 165/10 X

*Primary Examiner*—Albert W. Davis, Jr.

*Attorney, Agent, or Firm*—Robert J. Edwards; Mark B. Quatt

[57] ABSTRACT

A rotary regenerative heat exchanger wherein radial plates are connected to radial plate pins which engage a pair of core plates disposed about a rotor shaft and which permit axial, radial, and rotational movement.

3 Claims, 5 Drawing Figures

ROTOR CONSTRUCTION FOR ROTARY REGENERATIVE AIR HEATER

BACKGROUND OF THE INVENTION

1. Field of the Invention

The present invention relates to rotary regenerative heat exchangers wherein transfer of heat from a heating fluid to a cooling fluid is accomplished by means of heat-absorbent elements alternately exposed to the heating and cooling fluids. More particularly, the invention relates to a rotor construction featuring a rotor shaft and a series of radial plates disposed about the rotor shaft and attached to radial plate pins which help to accommodate system stresses associated with rotary regenerative heat exchanger operation.

2. Description of Prior Art

A common means of attaching the rotor structure to the central rotor shaft has been by welding. A disadvantage of use of such a welded connection is that thermal and bending stresses encountered during operation may result in failure of the weld.

Various rotor configurations for rotary regenerative air heaters have been developed in order to overcome the consequences of these stresses. For example, U.S. Pat. Nos. 3,155,152 (Conde), 3,710,850 (Kurschner et al) and 3,998,266 (Finnemore) are directed at means of reducing such effects through the use of tangential plates, universal-type joints, and ball-and-socket arrangements respectively.

U.S. Pat. No. 3,192,999 (Stockman) shows a support arrangement involving telescopic means to carry an upper rotor section through a lower bearing and a lower rotor section through an upper bearing so that the upper and lower rotor sections expand toward each other during operation.

U.S. Pat. No. 3,891,029 (Mahoney) discloses an arrangement featuring a double pin connection between each heating basket and the rotor shaft, and utilizing U-shaped rotor post brackets and tension and compression fittings to which the two pins are interconnected.

These and similar arrangements are complex in terms of fabrication and field assembly; some are limited to applications in horizontal-axis rotors. In addition, modular rotor construction wherein the heat transfer element units form an integral part of the rotor structure, i.e. are affixed to the shaft by a pinned connection, as shown in U.S. Pat. No. 3,710,850 (Kurschner et al) will allow only axial and possibly some radial movement.

SUMMARY OF THE INVENTION

This invention provides an arrangement in which a rotor assembly comprises a plurality of radial plates connected to a plurality of radial plate pins which engage an upper and lower core plate. The core plates are concentrically arranged about and attached to a rotor shaft. The pin connection permits axial, radial, and rotational movement to minimize the deleterious effects of thermal stresses created by temperature differentials within the rotor assembly. Cyclic bending stresses created by air to gas side pressure differentials are minimized, and fabrication and field assembly of the rotor are simplified.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

Figure 1:
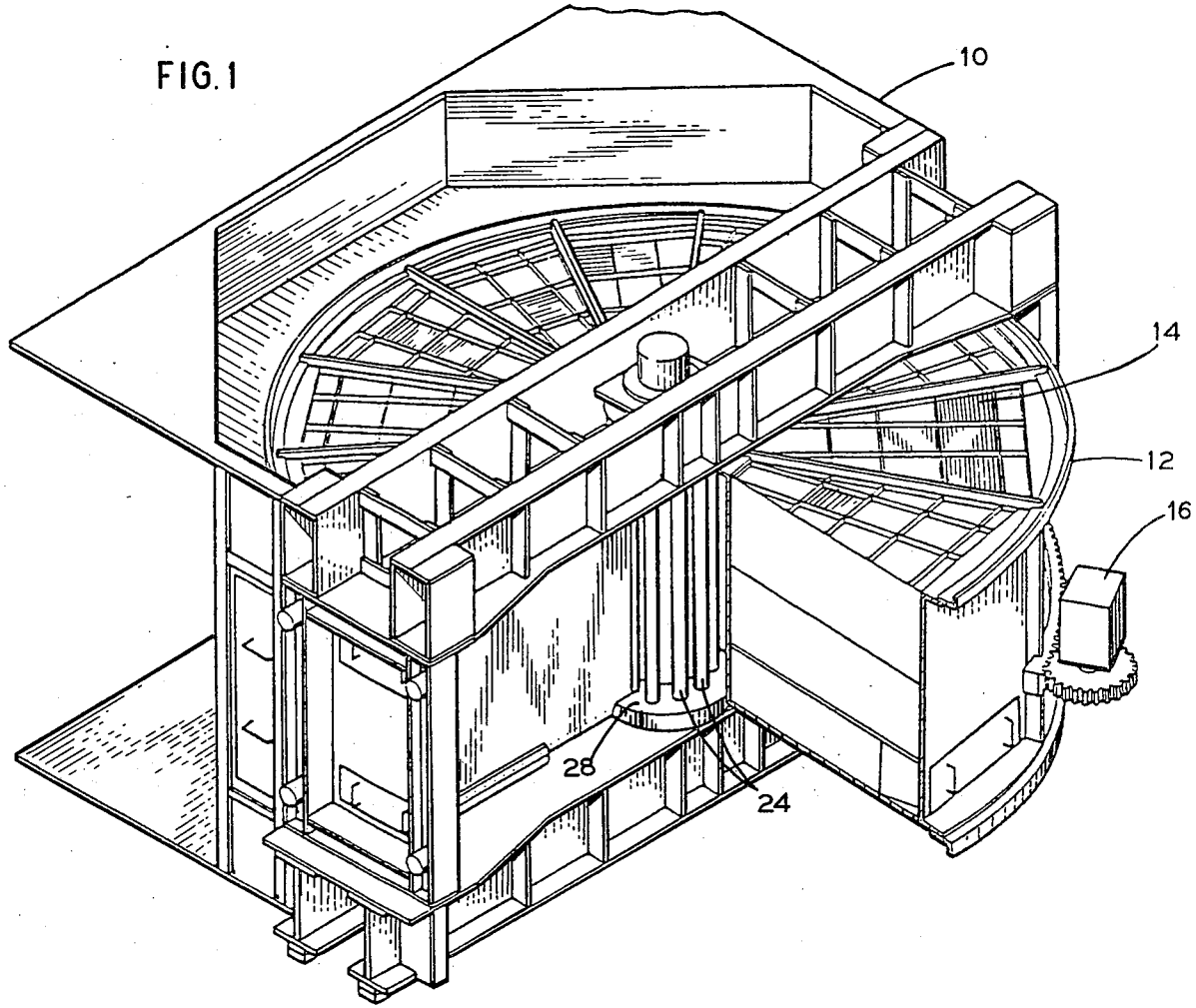
FIG. 1 is a perspective, cut-away view of a rotary regenerative heat exchanger made in accordance with the invention.

Referring to FIG. 1, a rotary regenerative heater is enclosed within a housing 10 with means including inlet and outlet ducts (not shown) for passing heating fluids through a rotor 12 to cause a heat transfer to heat-absorbent material 4 in the rotor 12. Means, including inlet and outlet ducts (not shown) are provided to pass cooling fluid, typically air, through the rotor to effect a heat transfer from the heat-absorbent material to the cooling fluid. The rotor is rotated about its axis by a drive means 16 such that the heat-absorbent material is alternately exposed to the heating and cooling fluids.

Figure 2:
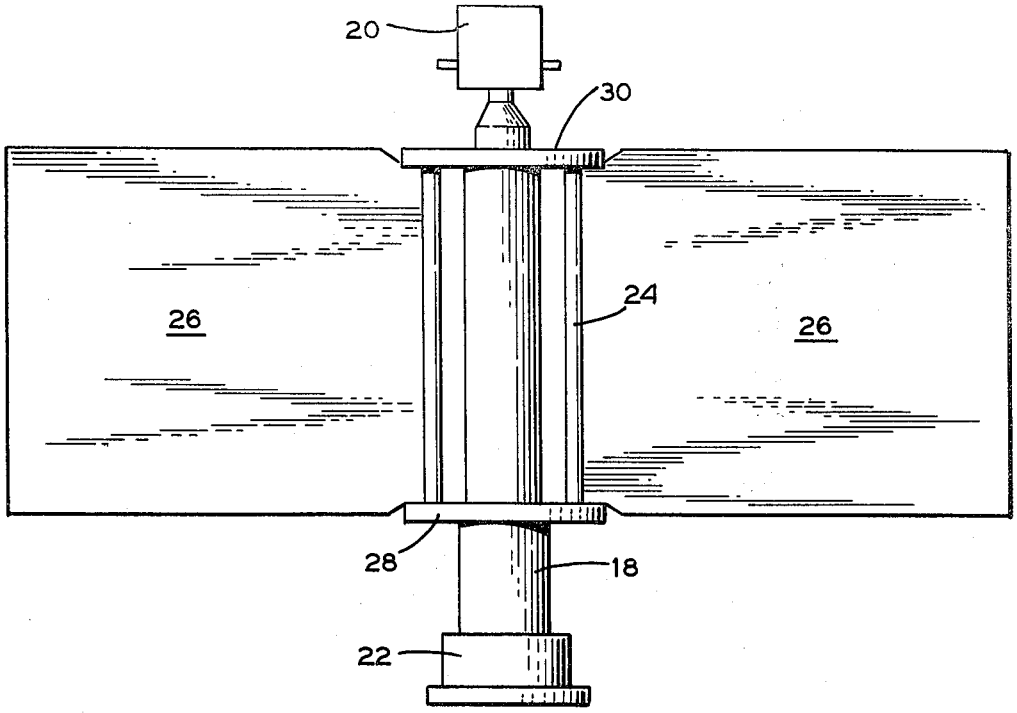
FIG. 2 is a side view of a rotor made in accordance with the invention.
Figure 3:
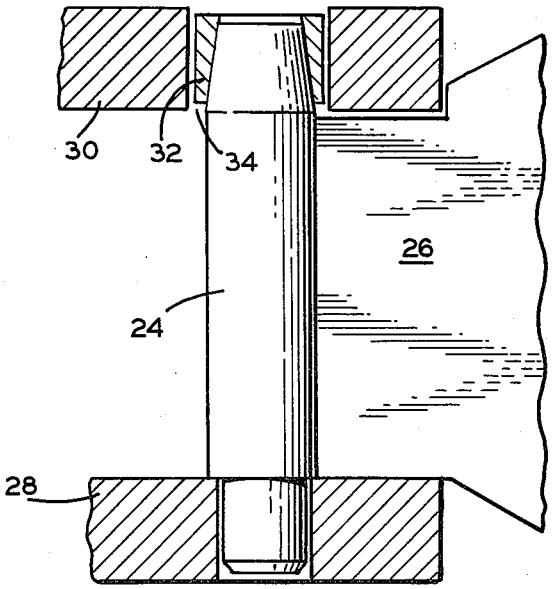
FIG. 3 is an enlarged sectional elevation showing the attachment of a radial plate to a radial plate pin which engages a core plate.

FIG. 2 shows a rotary regenerative heat exchanger having a rotor shaft 18 supported by an upper bearing 20 and lower bearing 22. Radial plate pins 24 are attached to respective radial plates 26, and the resulting radial plate assembly is installed in a lower core plate 28. A land (not shown) at the lower end of each radial plate pin 24, where it contacts the lower core plate, bears the thrust load of radial plate pin 24 and radial plate 26, and a proportionate part of full-sector basket 40. An upper core plate 30 is aligned over the radial plate pins and engages the radial plate pins by means of bushings 32 inserted into apertures 34 in the upper core plate (see FIG. 3). The radial plate pins have limited freedom to move axially, radially, or rotationally to absorb the thermal and pressure stresses encountered in rotary regenerative heat exchanger operation. The radial plates are connected to the radial plate pins, not the rotor shaft, to permit axial expansion of the rotor shaft caused by temperature differentials between the center and periphery of the rotor.

Figure 4:
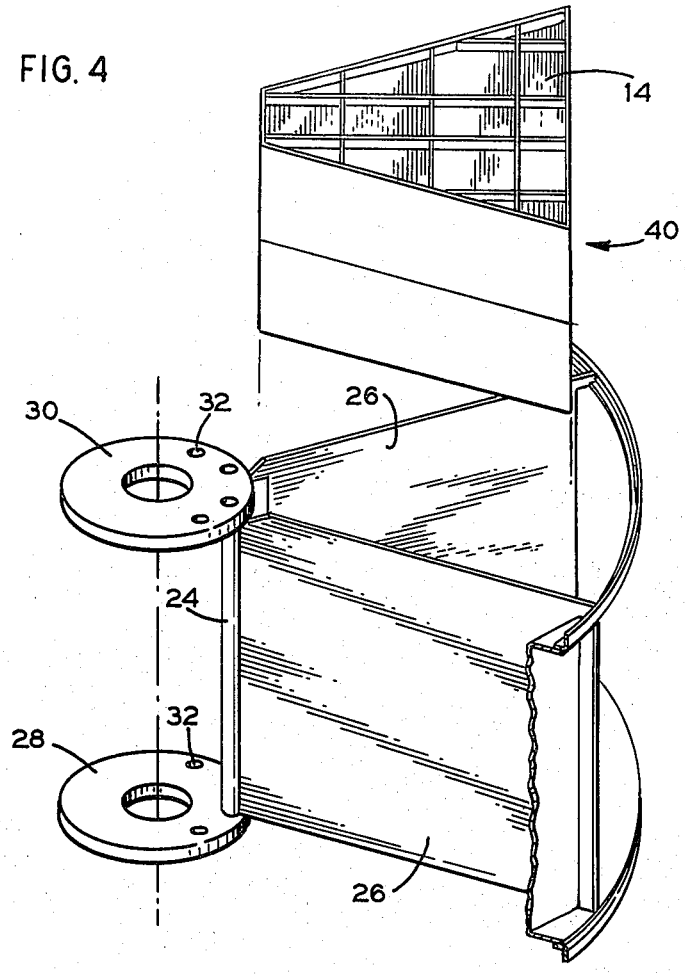
FIG. 4 is a perspective view of a part of the rotor and shows the structural relationship between core plates, radial plates, and radial plate pins.
Figure 5:
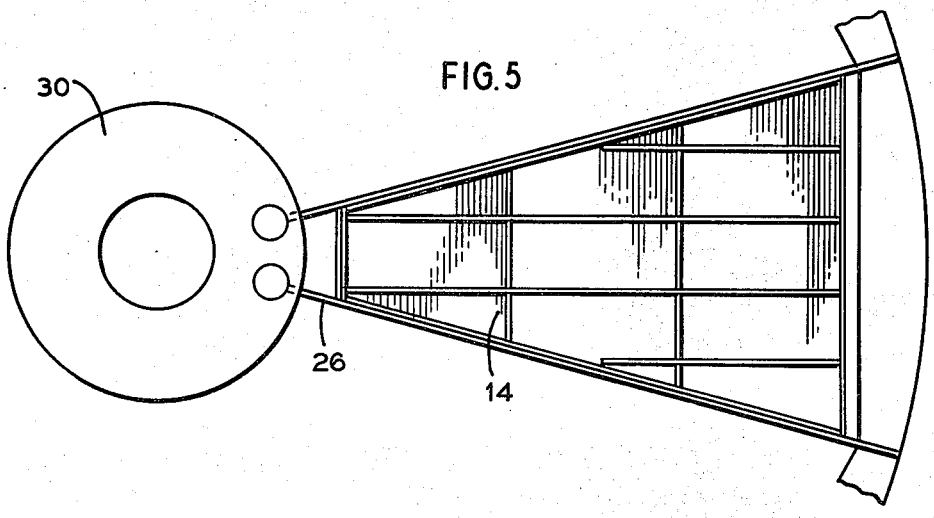
FIG. 5 is a schematic plan view of a typical heating element basket in relation to the radial plate configuration.

Referring to FIGS. 4 and 5, each adjacent pair of radial plates 26 form a compartment which encloses and restrains a plurality, typically two or three, of full-sector baskets 40 stacked vertically and containing heat-absorbent material 14. The full-sector baskets are independent of the rotor structure, while the enclosing radial plate members form an integral part of the rotor.

While in accordance with the provisions of the statutes, there is illustrated and described herein a specific embodiment of the invention, those skilled in the art will understand that changes may be made in the form of the invention covered by the claims and that certain features of the invention may be used to advantage without a corresponding use of the other features.

The embodiments of the invention in which an exclusive property or privilege is claimed are defined as follows:

1. A rotary regenerative heat exchanger comprising:

(a) a plurality of radial plates connected to a plurality of radial plate pins which engage an upper and lower core plate, each core plate concentrically surrounding and attached to a rotor shaft;

(b) a plurality of bushings inserted into apertures in the upper core plate, each bushing engaging the upper terminus of a corresponding radial plate pin, the lower core plate having apertures which engage the lower terminus of a corresponding radial plate pin;

(c) a plurality of full-sector baskets stacked vertically and retained within compartments formed by adjacent pairs of the radial plates, the baskets containing heat-absorbent material;

(d) means for passing heating and cooling fluids through the rotor; and (e) means for rotating the rotor about its axis.

2. A rotary regenerative heat exchanger according to claim 1 wherein the means for passing heating and cooling fluids through the rotor comprises a housing having inlet and outlet ducts for the flow of heating and cooling fluids.

3. A rotary regenerative heat exchanger according to claim 1 wherein the pair of core plates comprises an upper core plate concentrically surrounding and attached to the rotor shaft, and a lower core plate concentrically surrounding and attached to the rotor shaft, each core plate containing radially disposed apertures larger in diameter than the corresponding radial plate pins, the apertures of the upper and lower core plates in alignment.

* * * * *